US009315309B2

(12) United States Patent
Olsen et al.

(10) Patent No.: US 9,315,309 B2
(45) Date of Patent: Apr. 19, 2016

(54) CONTAINER CARRIER

(71) Applicants: Robert C. Olsen, Medinah, IL (US); Christopher J. Samaras, Tinley Park, IL (US)

(72) Inventors: Robert C. Olsen, Medinah, IL (US); Christopher J. Samaras, Tinley Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 54 days.

(21) Appl. No.: 13/801,609

(22) Filed: Mar. 13, 2013

(65) Prior Publication Data

US 2014/0262857 A1 Sep. 18, 2014

(51) Int. Cl.
*B65D 71/50* (2006.01)

(52) U.S. Cl.
CPC ..... *B65D 71/504* (2013.01)

(58) Field of Classification Search
CPC ..... B65D 71/504; B65D 85/67; B65D 2571/0066; B65D 2571/00141
USPC ..... 206/150, 145, 139
See application file for complete search history.

(56) References Cited

U.S. PATENT DOCUMENTS

| | | | | |
|---|---|---|---|---|
| 4,462,494 | A * | 7/1984 | Cunningham | 206/150 |
| 5,209,346 | A | 5/1993 | Pratt et al. | |
| 5,265,718 | A * | 11/1993 | Marco | 206/150 |
| 5,269,406 | A * | 12/1993 | Olsen et al. | 206/150 |
| 5,456,350 | A * | 10/1995 | Olsen et al. | 206/150 |
| 5,511,656 | A * | 4/1996 | Olsen | 206/150 |
| 6,056,115 | A | 5/2000 | Olsen | |
| 7,074,476 | B2 * | 7/2006 | Weaver et al. | 428/131 |
| 7,100,762 | B2 * | 9/2006 | Marco | 206/150 |
| 7,195,809 | B2 * | 3/2007 | Weaver et al. | 428/131 |
| 2005/0279650 | A1 * | 12/2005 | Marco | 206/150 |
| 2011/0259767 | A1 | 10/2011 | Olsen | |

FOREIGN PATENT DOCUMENTS

EP 1 077 185 A2 2/2001

* cited by examiner

*Primary Examiner* — Steven A. Reynolds
(74) *Attorney, Agent, or Firm* — Pauley Erickson & Kottis

(57) ABSTRACT

A flexible carrier for carrying a plurality of containers within a plurality of corresponding container receiving apertures that includes at least two rows of generally triangular shaped container receiving apertures each having an outer band including a pair of outwardly extending protrusions. The carrier further includes a separation aperture formed between each transverse rank of container receiving apertures whereby a width of the separation aperture is approximately equal to a width between each separation aperture.

18 Claims, 2 Drawing Sheets

CONTAINER CARRIER

BACKGROUND OF THE INVENTION

Field of the Invention

This invention relates to a container carrier for unitizing a plurality of containers.

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage.

SUMMARY OF THE INVENTION

The present invention is directed to a flexible carrier for packaging containers that includes a smaller footprint than known carriers and thus uses less material.

According to preferred embodiments of this invention, each flexible carrier preferably includes two rows of container receiving apertures, each for receiving a container, to form a package. The resulting carrier is configured to result in a tight, unitized bricklike package following application of the carrier to a corresponding array of containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
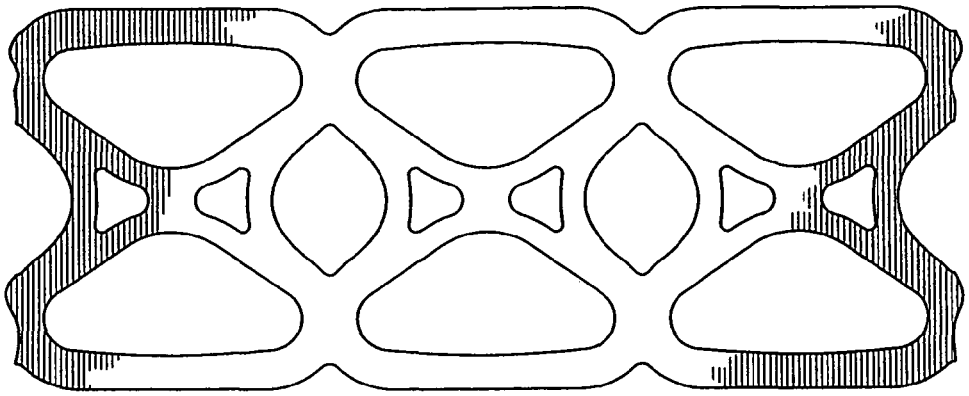
FIG. 1 PRIOR ART
FIG. 1 is a side elevational view of a container carrier according to the prior art.
Figure 2:
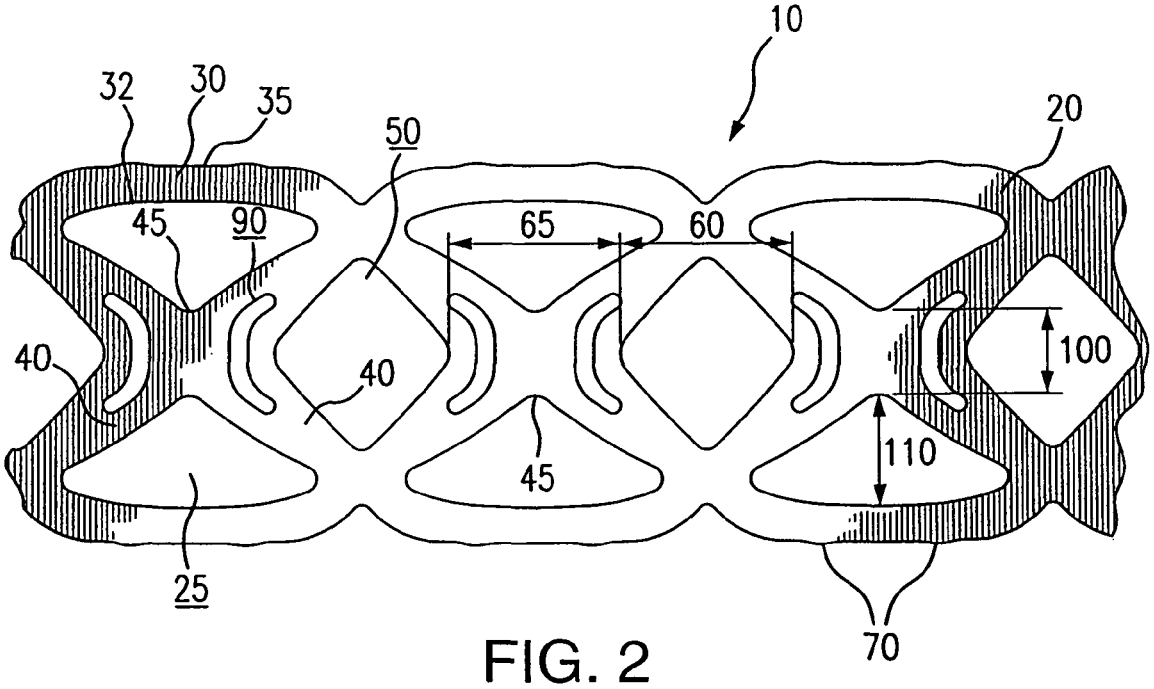
FIG. 2 is a side elevational view of a container carrier according to one preferred embodiment of this invention.
Figure 3:
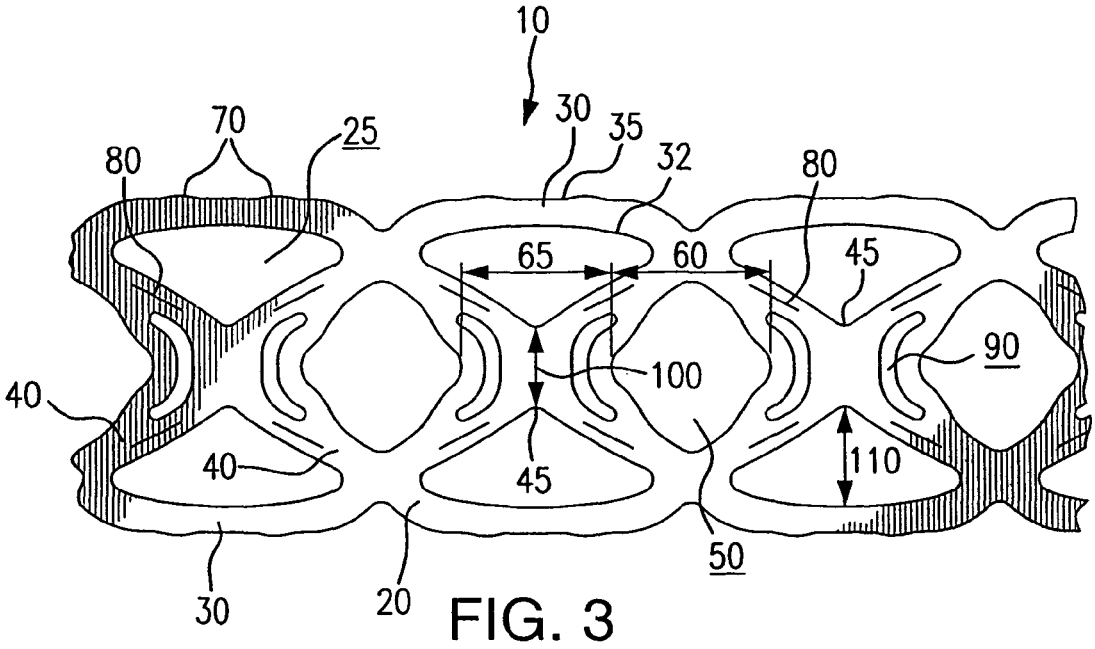
FIG. 3 is a side elevational view of a container carrier according to one preferred embodiment of this invention.
Figure 4:
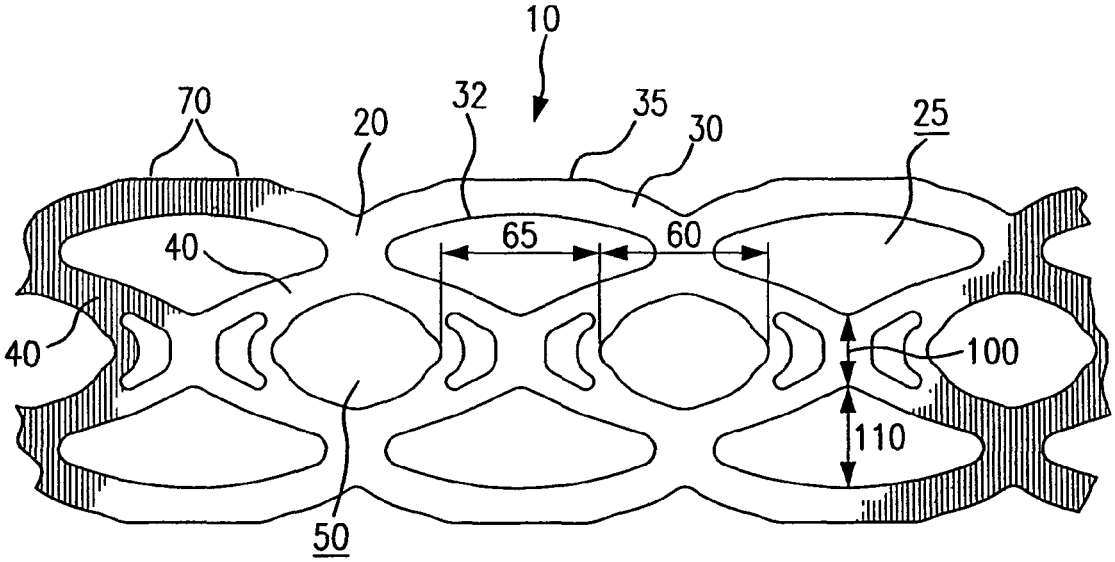
FIG. 4 is a side elevational view of a container carrier according to one preferred embodiment of this invention.

FIG. 1 shows a flexible carrier according to the prior art. FIGS. 2-4 show several embodiments of a flexible carrier 10 for unitizing six or more containers into a resulting unitized package. Although FIGS. 2-4 illustrate various structures for flexible carrier 10 of the invention, the illustrations are exemplary, and the invention is not limited to the flexible carriers 10 or packages shown. For example, flexible carrier 10 may be alternatively configured and used to unitize four, eight or any other desired number of containers.

Containers are preferably cans, however, bottles or any other commonly unitized container may be used with flexible carrier 10 according to this invention. The containers are preferably, though not necessarily, like-sized within a single flexible carrier 10.

Each flexible carrier 10 preferably includes a single layer of flexible sheet 20 having a width and length defining therein a plurality of container receiving apertures 25, each for receiving a container. The plurality of container receiving apertures 25 are preferably arranged in longitudinal rows and longitudinal ranks so as to form an array of container receiving apertures 25, such as two rows by three ranks for a six container multipackage as shown in FIGS. 2-4. Container receiving apertures 25 are preferably elongated in a longitudinal direction of flexible carrier 10.

As described above, the plurality of container receiving apertures 25 are preferably arranged in transverse pairs. As shown in FIGS. 2-4, two parallel rows of container receiving apertures 25 are preferably formed within flexible sheet 20. As such, one row of container receiving apertures 25 is preferably formed along each side of the carrier 10. Container receiving apertures 25 are preferably formed in a geometry that results in a tight unitization of containers without excess play and/or sliding between and among containers and flexible carrier 10.

The container carrier 10 according to a preferred embodiment of the invention includes a series of interconnecting webs that define the plurality of container receiving apertures 25. Such webs are stretchable around a container during application and recoverable around the container following application. According to a preferred embodiment, each container receiving aperture 25 stretches at least 35%, and more preferably, greater than 38%, when engaged with a respective container.

As shown in FIGS. 2 and 3, each container receiving aperture 25 preferably includes an outer band 30 and a pair of oblique inner bands 40 that together form a generally triangular shaped container receiving aperture 25. Each outer band 30 includes an inner edge 32 and an outer edge 35 wherein the inner edge 32 forms an engagement surface with a corresponding container and the outer edge 35 includes a pair of outwardly extending protrusions 70. More generally, the container carrier 10 preferably includes an outer band 30 that includes five changes of concavity along its length.

As shown in FIGS. 2 and 3, a small radius 45 is preferably formed between the pair of inner bands 40 at an inner corner of each container receiving aperture 25 thereby forming the generally triangular shaped container receiving aperture 25. According to a preferred embodiment of this invention, the small radius is approximately 0.1". This contrasts to prior art carriers wherein a corresponding radius is 0.25" or larger. In any event, the small radius 45 is smaller than a radius formed between each inner band 40 and the outer band 30.

The container carrier 10 preferably further includes a separation aperture 50 formed between each transverse rank of container receiving apertures 25. The separation aperture 50 preferably includes a width 60 that is approximately equal to a width 65 between each separation aperture 50. Existing carriers typically include a width 65 substantially larger than a width 60.

According to one preferred embodiment, the container carrier 10 may further comprise a pair of finger channels 90 positioned within each transverse rank between each separation aperture 50. As shown in FIGS. 2 and 3, each finger channel 90 generally follows a profile of a respective separation aperture 50. Further, each finger channel preferably maintains a generally consistent width throughout its length.

According to one preferred embodiment shown in FIG. 3, the container carrier 10 may further include a plurality of slits 80, each slit 80 positioned within a respective inner band 40. As shown, the slit 80 is preferably generally parallel to an edge of the inner band 40. Because of the narrow configuration of the container carrier 10 of this invention, the slit 80 provides some relief between the finger channels 90 and the container receiving apertures 25 when the container carrier 10 is carried or lifted by the consumer, thereby maintaining unitization of the package.

According to a preferred embodiment of this invention, a distance 100 between each container receiving aperture 25 in a transverse pair is less than a height 110, or altitude, of each container receiving aperture 25. More specifically, as shown in FIGS. 2 and 3, the distance 100 between each container receiving aperture 25 is roughly 80% of the height 110 of each container receiving aperture 25. Typical prior art ratios between the transverse distance between container apertures and the height of such container receiving apertures is 1:1.5.

FIG. 4 shows an additional embodiment for applying to smaller "sleek" containers and therefore having an even narrow width than the container carrier shown in FIGS. 2 and 3. In all such, embodiments, the container carrier 10 includes a narrower width than traditional container carriers in the prior art. Such narrower width enables the simultaneous manufacture of at least one and preferably two additional lanes or strings of container carriers 10 during the punching process while still maintaining the necessary integrity of the resulting unitized package of containers.

A package resulting from flexible carrier 10 includes a plurality of unitized containers. Flexible carriers 10 are generally applied to containers by stretching flexible sheet 20 surrounding container receiving apertures 25 around container, and requiring the stretched carrier 10 to recover, thereby providing a tight engagement. Generally such flexible carriers 10 are continuously punched and subsequently applied to containers using an applicating drum (not shown) which stretches a generally continuous string of container carriers 10 into engagement with individual containers using multiple jaw pairs that grasp container receiving apertures 25 along outer bands 30. In this manner, the pair of outwardly formed protrusions 70 preferably correspond with the ends of a pair of jaws for applying the carrier to the plurality of containers. By adding additional material to the outer bands 30 in the form of protrusions 70, a width of outer band 30 of the container carrier 10 is reduced but the integrity of the container carrier 10 is maintained in critical stretch zones, such as within the outer bands 30. The protrusions 70 act to protect the narrower portions of the outer bands 30 from necking down.

While in the foregoing specification this invention has been described in relation to certain preferred embodiments thereof, and many details have been set forth for purpose of illustration, it will be apparent to those skilled in the art that flexible carrier 10 is susceptible to additional embodiments and that certain of the details described herein can be varied considerably without departing from the basic principles of the invention.

The invention claimed is:

1. A carrier for unitizing a plurality of containers within corresponding container receiving apertures, the carrier comprising:

an array of container receiving apertures formed in longitudinal rows and transverse ranks wherein each container receiving aperture includes an outer band and a pair of oblique inner bands, each outer band having an inner edge and an outer edge, the inner edge forming an engagement surface with a corresponding container and the outer edge including a pair of outwardly extending protrusions comprising five changes in concavity along a length of the outer edge;

a small radius formed between the pair of inner bands at an inner corner of each container receiving aperture thereby forming a generally triangular shaped container receiving aperture, wherein a base of each triangular shaped container receiving aperture is convex and two sides forming the inner corner of each triangular shaped container receiving aperture are concave; and a separation aperture formed between each transverse rank of container receiving apertures whereby a width of the separation aperture is equal to a width between each separation aperture, wherein the separation aperture comprises a change in concavity between the each transverse rank of container receiving apertures.

2. The carrier of claim 1 wherein each container receiving aperture stretches at least 35% when engaged with a respective container.

3. The carrier of claim 1 further comprising a pair of finger channels positioned within each transverse rank between each separation aperture.

4. The carrier of claim 3 wherein each finger channel extends around a respective change in concavity of the separation aperture and generally follows a profile of a respective separation aperture.

5. The carrier of claim 1 further comprising a slit positioned within each inner band.

6. The carrier of claim 5 wherein the slit is generally parallel to an edge of the inner band.

7. The carrier of claim 1 wherein a distance between each container receiving aperture in a transverse pair is less than a height (altitude) of each container receiving aperture.

8. The carrier of claim 1 wherein the small radius is approximately 0.1".

9. The carrier of claim 1 wherein the small radius is smaller than a radius formed between each inner band and the outer band.

10. The carrier of claim 1 wherein the pair of outwardly formed protrusions correspond with a pair of jaws for applying the carrier to the plurality of containers.

11. A carrier for unitizing a plurality of containers within corresponding container receiving apertures, the carrier comprising:

an array of container receiving apertures formed in longitudinal rows and transverse ranks wherein each container receiving aperture includes an outer band and a pair of oblique inner bands, each outer band having an inner edge and an outer edge, the inner edge forming an engagement surface with a corresponding container and the outer edge including a pair of outwardly extending protrusions wherein each outer band includes five changes of concavity along its length, wherein a distance between each container receiving aperture in a transverse pair is less than a height of each container receiving aperture;

a small radius of approximately 0.1" formed between the pair of inner bands at an inner corner of each container receiving aperture thereby forming a generally triangular shaped container receiving aperture, wherein the small radius is smaller than a radius formed between each of the pair of inner bands and the outer band, and a base of each triangular shaped container receiving aperture is convex and two sides forming the inner corner of each triangular shaped container receiving aperture are concave; and a separation aperture formed between each transverse rank of container receiving apertures whereby a width of the separation aperture is equal to a width between each separation aperture.

12. The carrier of claim 11 further comprising a slit positioned within each inner band.

13. The carrier of claim 12 wherein the slit is generally parallel to an edge of the inner band.

14. A carrier for unitizing a plurality of containers within corresponding container receiving apertures, the carrier comprising:

an array of container receiving apertures formed in longitudinal rows and transverse ranks wherein each container receiving aperture includes an outer band and a pair of oblique inner bands that together form a generally triangular perimeter, each outer band having an inner edge and an outer edge, the inner edge forming an engagement surface with a corresponding container, and the outer edge including a pair of outwardly extending protrusions wherein each outer band includes five changes of concavity along its length, wherein a distance between each container receiving aperture in a transverse pair is less than a height of each container receiving aperture;

a small radius formed between the pair of inner bands at an inner corner of each container receiving aperture thereby forming a generally triangular shaped container receiving aperture, wherein the small radius is smaller than a radius formed between each of the pair of inner bands and the outer band, and a base of each triangular shaped container receiving aperture is convex and two sides forming the inner corner of each triangular shaped container receiving aperture are concave;

a slit positioned within each inner band generally parallel to the an edge of the inner band, wherein the slit does not form an opening in the carrier;

a separation aperture formed between each transverse rank of container receiving apertures, the separation aperture comprises two opposing changes in concavity each between a respective transverse rank of container receiving apertures and whereby a width of the separation aperture between the two opposing changes of concavity is equal to a width between each separation aperture.

15. The carrier of claim 14 further comprising the small radius of approximately 0.1" formed between the pair of inner bands at an inner corner of each container receiving aperture.

16. The carrier of claim 1 wherein the separation aperture comprises four sides and a radius formed at a corner between each adjacent two of the four sides.

17. The carrier of claim 11 wherein the separation aperture comprises a change in concavity between the each transverse rank of container receiving apertures.

18. The carrier of claim 11 further comprising a pair of finger channels positioned within each transverse rank between each separation aperture, wherein each finger channel generally follows a profile of a respective separation aperture and extends around a respective change in concavity of the respective separation aperture.

* * * * *